US005265298A

United States Patent [19]

Young

[11] Patent Number: 5,265,298

[45] Date of Patent: Nov. 30, 1993

[54] CONTAINER CLEANING SYSTEM USING IONIZED AIR FLOW

[76] Inventor: Raymond Young, 891 White Stag La., Canton, Ga. 30114

[21] Appl. No.: 840,826

[22] Filed: Feb. 25, 1992

[51] Int. Cl.[5] ..... B08B 1/02

[52] U.S. Cl. ..... 15/1.51; 15/304; 15/309.2; 15/345

[58] Field of Search ..... 15/306.1, 309.2, 308, 15/345, 1.51, 304

[56] References Cited

U.S. PATENT DOCUMENTS

| | | | |
|---|---|---|---|
| 2,644,188 | 7/1953 | Pacilio | 15/304 |
| 4,751,759 | 6/1988 | Zoell | 15/1.51 |
| 4,854,441 | 8/1989 | McBrady et al. | 15/309.2 X |
| 4,883,542 | 11/1989 | Voneiff | 15/308 X |

*Primary Examiner*—Chris K. Moore
*Attorney, Agent, or Firm*—Harry I. Leon

[57] ABSTRACT

An apparatus for cleaning dust particles from open-ended cans and the like in an automated container filling assembly line. The apparatus utilizes an ionized air injector with a nozzle and a vacuum source having an inlet positioned in close proximity thereto. Both the injector nozzle and the inlet are situated so that the containers can be made to move with their open ends crossing the paths of air flows directed from the nozzle and into the inlet. By means of the injector, an ionized air stream is directed into each empty container to dislodge any dust particles there and to neutralize electrostatic charges causing the particles to adhere to the container walls. Suction, acting through the vacuum source inlet immediately downstream of the ionized air flow, removes any dislodged dust particles before electrostatic charges can build up again between them and the container. The apparatus further includes an enclosure surrounding the injector nozzle and vacuum source inlet. The enclosure, through whose end openings the containers pass virtually unimpeded, is pressurized with filtered air to keep the containers from being recontaminated immediately after cleaning. Ideally, the enclosure is sited close to the location where the containers are ultimately filled and sealed. For highly efficient cleaning, a series of ionized air injector nozzles each followed by its own vacuum source inlet is employed. The apparatus can be readily added to a conventional automated container filling assembly line.

5 Claims, 4 Drawing Sheets

Fig. 5.
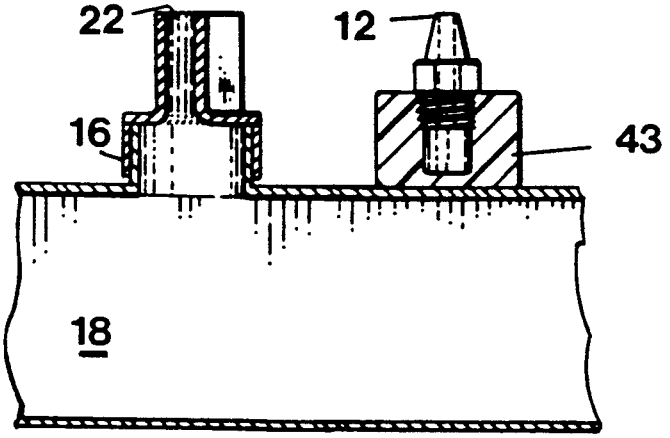
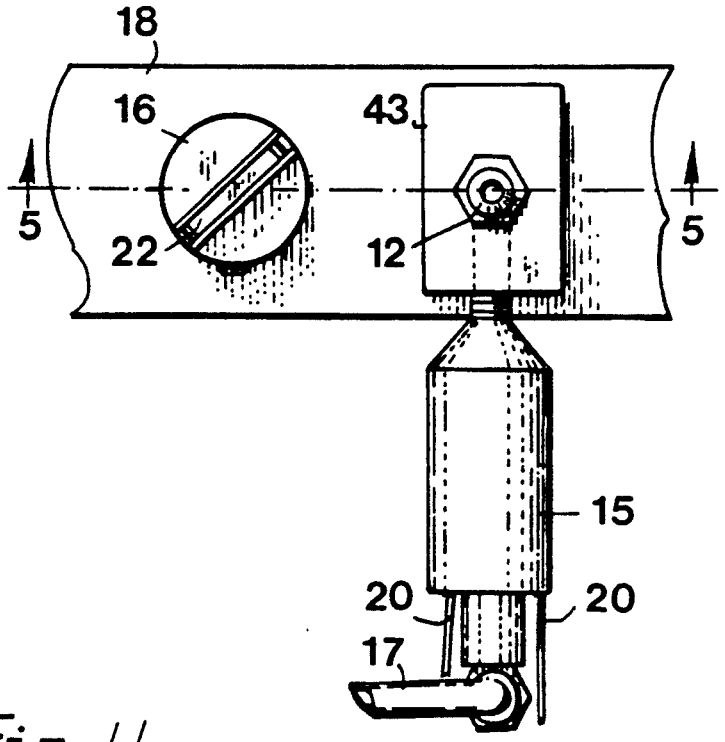
Fig. 4.

CONTAINER CLEANING SYSTEM USING IONIZED AIR FLOW

BACKGROUND OF THE INVENTION

Empty metal cans intended for beverage use and the like typically become contaminated with foreign material such as paper and wood dust during shipping by pallet and as they are being processed in a factory. In the latter case, contact between the cans and the surfaces of articles, such as plastic chains, used to convey the cans cause them to pick up a slight net electrostatic charge, attracting fine particles to the can walls.

The dust particles contaminating these cans are characteristically extremely small, measuring less than 10 microns in diameter. Any electrostatic charges on the cans induce opposite charges on the particles to attract and hold them on the can walls. To remove particles adhering to the walls, these opposite charges must be neutralized. Neutralizing the charges is difficult, however, because the charges holding each dust particle to a can wall are shielded by the dust particle itself. Moreover, once the electrostatic forces have been momentarily abated, the freed dust particles must be removed immediately before they can re-attach themselves to the container.

In the prior art, the processing of empty metal cans in preparation for filling them with beverages and the like included spraying the cans with water. This cleaning technique, however, removes only about one-half of the dust particles inside the cans. Moreover, the high humidity generated by the water sprays favors the growth and spread of microorganisms, creating additional problems in the typical factory environment.

SUMMARY OF THE INVENTION

The present invention is directed to an improved container cleaning apparatus and method for cleaning, without the use of water sprays, topless, generally cylindrical containers of uniform shape and size as they travel along an assembly line. The containers preferably enter the apparatus in an upside down position and slide downwardly through it on a pair of inclined guide rails which are spaced apart from and in generally parallel alignment with each other. Alternately, the containers can be conveyed through the apparatus on a moving belt.

The guide rails are part of an elongated structure formed of multiple parallel guide rails. In the preferred embodiment, the elongated structure extends through, as well as fore and aft of, a pressurized enclosure. In addition to the pair of rails on which the containers slide, guide rails are disposed proximate with the top and sides of the containers as they move through the apparatus. The guide rails comprise means for limiting the movement, in both the vertical and lateral directions, of each container as it traverses the enclosure longitudinally. The guide rails also allow each container to travel, virtually unimpeded, through the cleaning system as the container is being cleaned.

The apparatus further includes one or more cleaning stations positioned between the bottom pair of guide rails, with the highest points of each station being disposed slightly downwardly of an imaginary plane spanning the upper surfaces of this pair of guide rails. Each cleaning station comprises an ionized air injector with a nozzle and a vacuum source having an inlet positioned in close proximity thereto.

As the containers slide on the rails, an ionized air stream is directed from the nozzle into each empty container to dislodge any dust particles there and to neutralize electrostatic charges on them and the container walls. Suction from the vacuum inlet, a slot situated immediately downstream of the nozzle through which the ionized air flow is sprayed, removes dislodged dust particles. Dust removal with the apparatus is enhanced when the slot is oriented at an acute angle, preferably about 45 degrees, to the longitudinal axis of each of the bottom guide rails. The outlet of the nozzle and the vacuum inlet are separated by a distance which is less than the diameter of the open end of each container to provide a degree of overlap in the reverse-acting air flows of the nozzle and of the vacuum inlet, thereby adding to the level of turbulence within a container as it encounters these air flows. Greater turbulence increases the likelihood that a dust particle, once it has been suspended in these air flows, will be removed from the container altogether, improving cleaning efficiency.

In the preferred embodiment, the ionized air stream is generated in the injector by passing compressed air over an electrode located upstream of the nozzle outlet. The electrode, which is supplied with a high voltage, low frequency alternating current, causes air molecules to become charged. By way of example, an alternating current of 5 kV at 3 to 5 cycles per second has been found to be suitable for this application. The compressed air is maintained at a pressure which is less than that which would cause a container to stall against the upper guide rail as the ionized air stream impacts upon it. In an apparatus for cleaning standard metal beverage cans in which the guide rails are inclined at an angle of 35 degrees to the horizontal, the compressed air is preferably maintained at a pressure of less than 5 psig.

When more than one cleaning station is employed in a cleaning system according to the present invention, the stations are preferably deployed in close proximity to each other. Such an arrangement of the stations takes advantage of the dislodgement of dust particles occurring as a result of the containers hitting against first the upper guide rail and then the lower guide rails as the air flows of the cleaning station disposed immediately upstream of each additional station impact upon the containers.

To prevent recontamination of the containers by their exposure to factory air, the enclosure is preferably pressurized with filtered air, using a blower with an inlet filter.

BRIEF DESCRIPTION OF THE DRAWINGS

FIG. 4 is a plan view of a fragmentary section of the container cleaning system according to the present invention; and FIG. 5 is a cross-sectional view taken on line 5—5 of FIG. 4.

DETAILED DESCRIPTION OF THE PREFERRED EMBODIMENT

Figure 1:
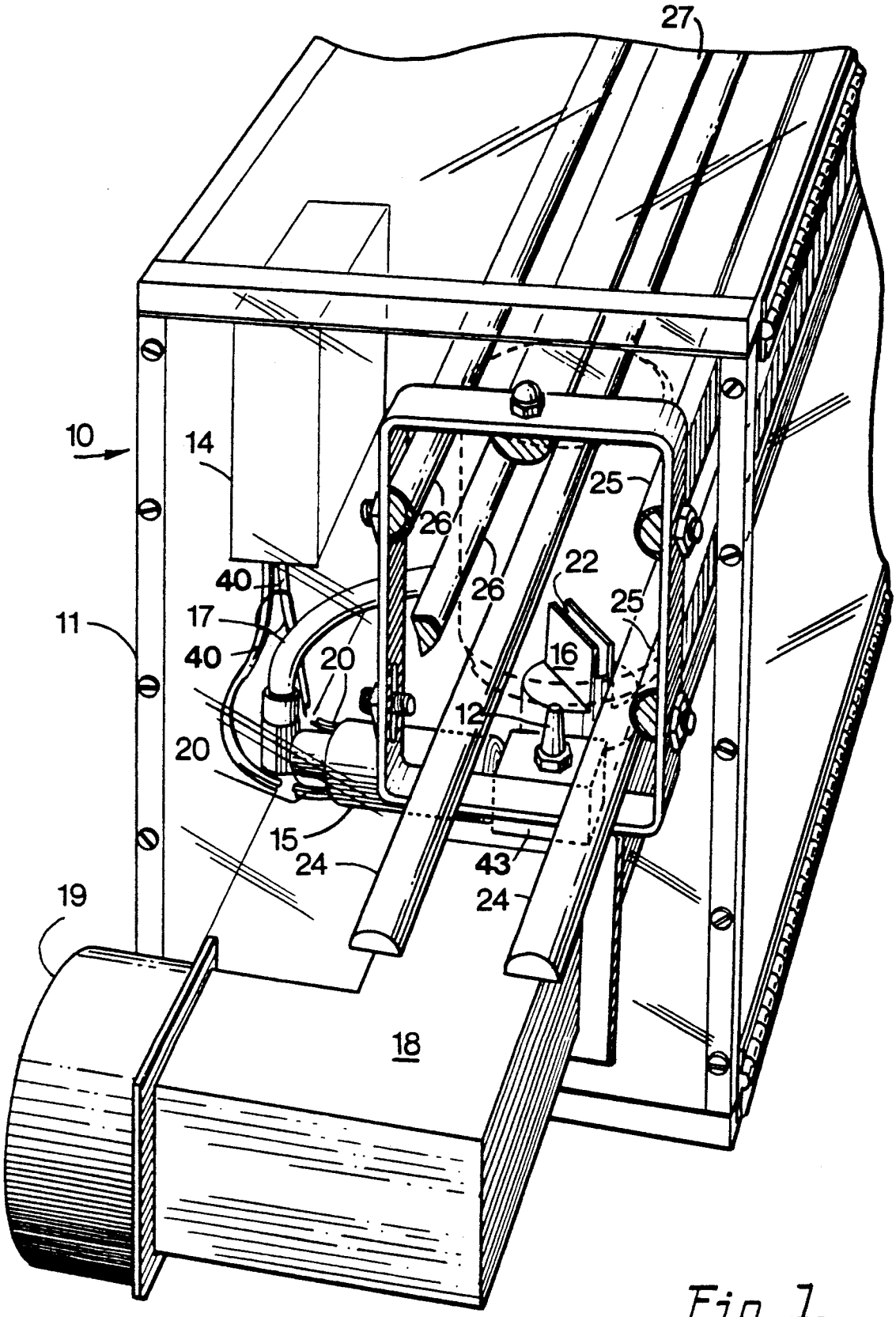
FIG. 1 is a perspective view of a container cleaning system according to the present invention, a single container cleaning station being illustrated for the sake of clarity.
Figure 2:
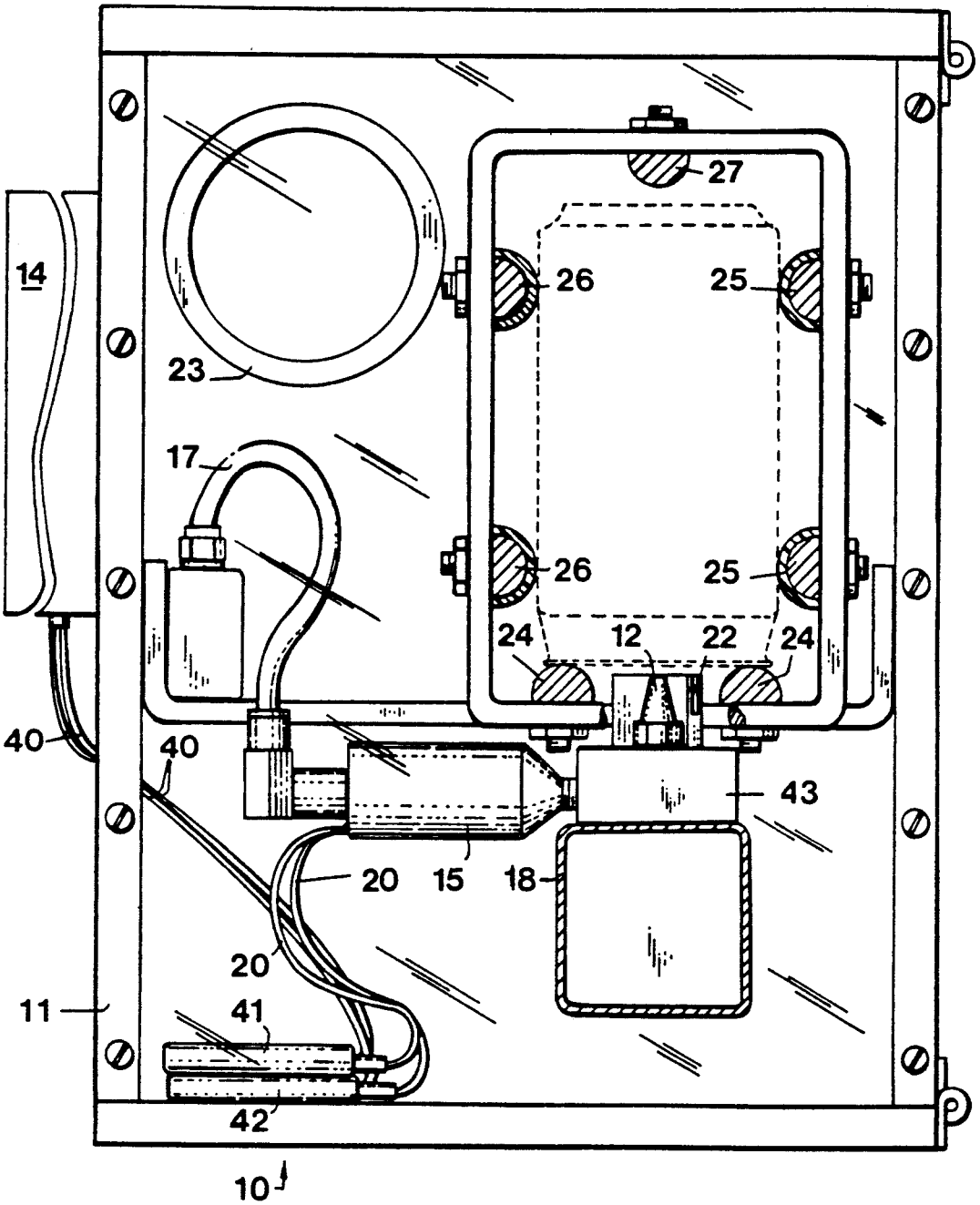
FIG. 2 is a frontal end elevation view of the container cleaning system according to FIG. 1.
Figure 3:
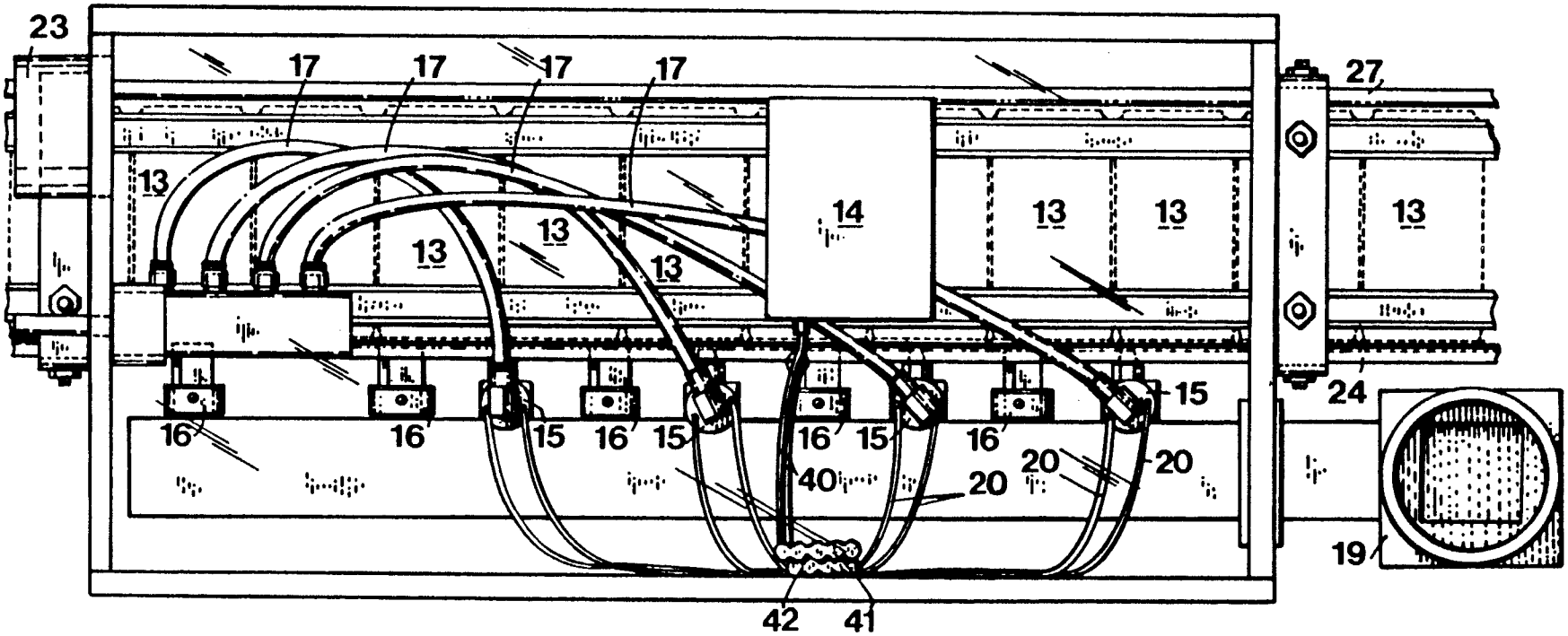
FIG. 3 is a side elevation view of a container cleaning system according to the present invention showing multiple cleaning stations.

Referring now to the drawings, wherein like corresponding reference numerals are used to designate like or corresponding parts throughout the several views, there is shown in FIGS. 1-3 a container cleaning system according to the present invention indicated generally by the reference numeral 10. The container cleaning system 10 comprises an open-ended enclosure 11 within which is located at least one cleaning station including an ionized air injector 15 having a nozzle 12 through which ionized compressed air is sprayed upwardly and an inlet 16 for a vacuum source (not shown). The enclosure 11 itself, in an embodiment having room for at least four cleaning stations, measures, by way of example, 36 inches long by 9 inches wide by 12 inches high. Extending longitudinally through the enclosure 11 and from both ends thereof are a pair of bottom guide rails 24, straddling the nozzle 12 and the vacuum inlet 16.

As is best seen in FIG. 2, the tip of the nozzle 12 and the upper edges of the vacuum inlet 16 are disposed only slightly beneath the open end of the container 13 sliding directly over them. In the preferred embodiment, the highest points on the nozzle 12 and the inlet 16 are disposed about one-fourth inch below an imaginary plane spanning the upper surfaces of the guide rails 24.

Supported by structural members attached to the enclosure 11, the guide rails 24, as well as guide rails 25, 26, 27, are maintained in generally parallel alignment with each other, the guide rails forming a raceway which limits the vertical and lateral movements of the containers 13 as they move through the enclosure 11. In the preferred embodiment, the containers 13 can bob up and down in the raceway through a vertical distance of about one-fourth inch. When gravity is harnessed to propel the containers through the enclosure 11, the guide rails 24 are inclined downwardly at an angle which measures, by way of example, about 35 degrees to the horizontal. Extensions (not shown) of the guide rails 24, 25, 26, 27 can be coupled thereto to facilitate moving the containers 13 to and from other stations (not shown) in an automated container filling assembly line. Alternately, the enclosure is mounted astride the moving belt of a conveyor (not shown) employed to transport the containers 13 to a location where they can be filled. Preferably, the system 10 is employed in an assembly line in which water sprays are eliminated altogether, along with the problems such sprays cause because of the high humidity they produce, the high humidity stimulating the growth of microbial organisms.

In use, each container 13 slides in an inverted position on the bottom pair of guide rails 24, with the open end of the container facing downwardly. Inside the enclosure 11, the containers 13 encounter ionized, compressed air sprayed from the nozzle 12 of the first cleaning station. The force of the compressed air tends to physically dislodge dust particles held by electrostatic charges to the walls of the container. The impact of the compressed air also causes the container 13 to bounce against the upper guide rail 27, contributing to the dislodgement of the dust particles. Once exposed, ions in the air flow neutralize these charges, thereby eliminating attractive forces between the dust particles and the container walls. Suction from the vacuum inlet 16, over which the containers 13 travel immediately downstream of the ionized compressed air spray, then pulls suspended dust particles out of the container 13 and into a slot 22 forming the entrance to the vacuum inlet 16. From the inlet 16, the dust particles are sucked into a vacuum manifold 18 which is fluidly connected, by an adapter 19, to the vacuum source.

Entering an elbow connected to the injector 15 through a supply tube 17, filtered compressed air is ionized and then forced into passageways within a support 43 which feed into the nozzle 12 (FIGS. 4 and 5). In the preferred embodiment, the ionized air injector 15 is unit model number AN-6, developed and marketed by Static Control Services, Inc., of Palm Springs, Calif. The injector 15 is connected by wires 20 to a pulse controller 14 also supplied by Static Control Services, Inc. In use, the controller 14 is adjusted to give a static free discharge from the injector nozzle 12, as measured by a hand-held static meter, at an alternating current of about 10 microamps at a frequency of 3 to 5 cycles per second and at an output voltage in a range of 5 kV to 12 kV. For container cleaning systems with multiple cleaning stations, the output of the pulse controller 14 is preferably connected by wires 40 to terminal blocks 41, 42 and thence to individual injectors 15 by wires 20 as shown in FIGS. 2 and 3.

The vacuum inlet 16 defines a slot 22 which, because the inlet can be detached and rotated about its mounting on the vacuum manifold 18, can be set at virtually any angle with respect to the longitudinal axes of the guide rails 24. From tests, it has been found that dust removal from standard beverage cans is enhanced significantly when the slot 22 is oriented at an angle to the longitudinal axes of the guide rails 24 rather than being aligned generally parallel to them. The most efficient dust removal occurs when the angle between the longitudinal axes of the slot 22 and of the guide rails 24 is about 45 degrees.

A blower (not shown), which discharges prefiltered air, is fluidly connected to the enclosure 11 at a connector 23 (FIGS. 2 and 3). The blower keeps the pressure inside the enclosure higher than that of the ambient air surrounding it, preventing air-borne dust in the factory from entering the enclosure and recontaminating the containers 13 after they have been cleaned. For the pressurization of the enclosure 11, a suitable blower is a Dayton model 2C940 blower having a $7\frac{3}{4}$ inch diameter wheel and powered by an $\frac{1}{3}$ horsepower, 3450 rpm electric motor. A fine dust filter, Dayton brand no. 2W708, can be placed at the blower inlet to remove dust which would otherwise enter the blower.

A suitable vacuum source for the cleaning system 10 is a second Dayton model 2C940 blower. In this instance, the inlet of the blower is attached to the vacuum manifold adapter 19.

Alternately, the vacuum manifold 18 and the connector 23 can be supplied by a single blower which feeds filtered, pressurized air into the enclosure 11 through the connector 23 and withdraws air laden with dust particles dislodged from the containers 13 through the vacuum manifold adapter 19. Baffles (not shown) must be provided to balance the respective air flows involved in capturing the dislodged dust and in simultaneously preventing its return through the ambient air to the enclosure 11 when a single blower is employed.

In actual field tests, an enclosure 11 with four cleaning stations, each equipped with an ionized air injector 15 followed by a vacuum inlet 16, was employed. The slot 22 of each inlet 16 was oriented at a 45 degree angle to the guide rails 24, and the tip of the nozzle 12 and the upper edges of the inlet 16 were disposed approximately one-fourth inch beneath the path traversed by the containers 13. Aluminum containers of a standard size and shape such as those used for beverages were slid down the guide rails 24, inclined at 35 degrees to the horizontal, and moved through the enclosure 11 at a rate of 1500 containers per minute. Test results showed that substantially more dust particles were removed from the containers 13 than would have been removed using the water spray which the cleaning system 10 replaced. Indeed, test results for a system 10 having only a single cleaning station showed levels of dust removal equal to, or better than those, obtained using water sprays.

It is apparent from the foregoing that a new and improved apparatus for waterless cleaning of containers has been provided. While only the presently preferred embodiment of the invention has been disclosed, as will be apparent to those familiar with the art, certain changes and modifications can be made without departing from the scope of the invention as defined by the following claims.

I claim:

1. An apparatus for removing dust particles from empty containers while they move forwardly, in a line, along a predetermined course, each container having at least one open side, the open side facing in a generally common direction with the open side of each of the containers contiguous with said container, comprising:

(a) an open-ended enclosure, which is pressurized above atmospheric pressure, the predetermined course traversing the enclosure longitudinally;

(b) at least one injector mounted within the enclosure, the injector having a nozzle adapted for spraying ionized compressed air, the nozzle being disposed generally perpendicularly to the direction of forward motion of the containers along the predetermined course and proximate therewith, so that ionized compressed air sprayed from the nozzle can be directed into the open side of each container as it passes the nozzle; and (c) at least one vacuum inlet situated immediately downstream of each nozzle and proximate with the predetermined course, for removing any dust particles suspended within the container, the nozzle having an outlet, the outlet of the nozzle and the vacuum inlet being spaced apart from each other by a distance which is a substantial portion of, but less than, the greatest distance between any two points on the open end of each container so as to provide a degree of overlap in the air flows of the nozzle and of the vacuum inlet, thereby adding to air turbulence within each container as it encounters these air flows.

2. An apparatus for removing dust particles from empty containers while they move forwardly, in a line, along a predetermined course, each container having at least one open side, the open side facing in a generally common direction with the open side of each of the containers contiguous with said container, comprising:

(a) an open-ended enclosure, which is pressurized above atmospheric pressure, the predetermined course traversing the enclosure longitudinally;

(b) at least one injector mounted within the enclosure, the injector having a nozzle adapted for spraying ionized compressed air, the nozzle being disposed generally perpendicularly to the direction of forward motion of the containers along the predetermined course and proximate therewith, so that ionized compressed air sprayed from the nozzle can be directed into the open side of each container as it passes the nozzle; and (c) at least one vacuum inlet situated immediately downstream of each nozzle and proximate with the predetermined course, for removing any dust particles suspended within the container, the vacuum inlet including structure which defines an elongated slot with an imaginary longitudinal centerline, the elongated slot being disposed with the longitudinal centerline disposed at an acute angle to the direction of forward motion of the containers along the predetermined course.

3. An apparatus for cleaning dust particles from empty containers while they are moving forwardly, in a line, along a predetermined course, each container having at least one open side which faces in a generally common direction with the open side of each of the containers contiguous with said container, comprising:

(a) an open-ended enclosure which is pressurized above atmospheric pressure and through which the predetermined course extends longitudinally;

(b) a compressed air manifold having at least one ionized air injector fluidly connected thereto and fluidly communicating with the enclosure;

(c) a vacuum manifold fluidly connected to a vacuum source, the manifold having at least one vacuum inlet, the inlet fluidly communicating with the enclosure, the air injector and vacuum inlet being disposed within the enclosure in such a way that the open end of each container is subjected first to a blast of compressed air from the air injector and then to suction from the vacuum inlet; and (d) means for limiting travel of the containers in a direction generally perpendicular to the forward motion of the containers while allowing them to move back and forth in said direction as they are alternately blasted by compressed air and pulled toward the vacuum inlet, so that when the containers move into fluid contact with air flows coming from the injector and going to the inlet, dust particles adhering to containers tend to be dislodged, to have their electrostatic charges neutralized, and to be sucked from the containers.

4. The apparatus according to claim 3 wherein the means for limiting travel of the containers further comprises at least one pair of guide rails disposed generally parallel to each other and extending longitudinally within the enclosure, each container impacting first one guide rail and then the other as the container moves back and forth in response to air flows coming from the injector and going to the vacuum inlet, the dislodgement of dust and particulate matter from the containers being facilitated by impact of the containers upon the guide rails.

5. The apparatus according to claim 3 wherein the compressed air manifold has a plurality of ionized air injectors fluidly connected thereto and the vacuum manifold has a plurality of vacuum inlets, each air injector having an outlet, each vacuum inlet being disposed, along the predetermined course, immediately downstream of one of the outlets of the air injectors, so that as the containers move through the enclosure they are subjected to progressively more cleaning action.

* * * * *